US005859498A

United States Patent [19]

Durand et al.

[11] Patent Number: 5,859,498

[45] Date of Patent: Jan. 12, 1999

[54] MULTISTAGE ELECTRON COLLECTOR WITHSTANDING HIGH VOLTAGES AND ELECTRON TUBE PROVIDED WITH SUCH A COLLECTOR

[75] Inventors: Alain Durand, Velizy Villacoublay; Serge Peron, Meudon, both of France

[73] Assignee: Thomas Tubes Electroniques, Meudon la Foret, France

[21] Appl. No.: 678,689

[22] Filed: Jul. 11, 1996

[30] Foreign Application Priority Data

Jul. 18, 1995 [FR] France ..... 95-08661

[51] Int. Cl.[6] ..... H01J 23/033

[52] U.S. Cl. ..... 315/5.38

[58] Field of Search ..... 315/5.38

[56] References Cited

FOREIGN PATENT DOCUMENTS

| | | | |
|---|---|---|---|
| 146567 | 12/1978 | Japan | 315/5.38 |
| 56-52840 | 5/1981 | Japan . | |
| 128634 | 8/1983 | Japan | 315/5.38 |
| 61-214327 | 9/1986 | Japan . | |
| 4277445 | 10/1992 | Japan | 315/5.38 |
| 5128974 | 5/1993 | Japan | 315/5.38 |
| 2 261 765 | 5/1993 | United Kingdom . | |

OTHER PUBLICATIONS

Toshikazu Kimura, et al, "A 12 GHz, 200 W Helix Traveling–Wave Tube For Broadcasting Satellites", 298, N.E.C. Research & Development 1983, Apr., No. 69, Tokyo, Japan, pp. 95–100.

Yoji Morishita, et al., "Development of 200 W TWT's For Broadcasting Satellites", 2135 N.H.K. Laboratories Note, 1984 Sept., No. 306, Tokyo, Japan, pp. 2–11.

Michael E. Read, et al., "Depressed Collectors For High–Power Gyrotrons", 8093 IEEE Transactions on Electron Devices 37, 1990 Jun., No. 6, Part II, New York, US, pp. 1579–1589.

*Primary Examiner*—Benny T. Lee
*Assistant Examiner*—Justin P. Bettendorf
*Attorney, Agent, or Firm*—Oblon, Spivak, McClelland, Maier & Neustadt, P.C.

[57] ABSTRACT

Disclosed is a multistage electron collector for electron tubes. This collector comprises an imperviously sealed envelope subjected to vacuum with an input wall and a back. Within, there is a succession of electrodes and dielectric spacers. Two successive electrodes are insulated by a spacer of a first type in contact with the two electrodes and having no contact with the envelope. A spacer of a second type is in contact firstly with the electrode closest to the back and secondly with the back. Application to electron tubes, especially millimeter travelling wave tubes.

16 Claims, 4 Drawing Sheets

MULTISTAGE ELECTRON COLLECTOR WITHSTANDING HIGH VOLTAGES AND ELECTRON TUBE PROVIDED WITH SUCH A COLLECTOR

BACKGROUND OF THE INVENTION

The present invention relates to the field of electron tubes and especially to travelling wave electron tubes working with millimeter waves (corresponding to frequencies of over 30 GHz).

Their working is based on an exchange of energy between a linear electron beam and a electromagnetic wave at a microwave frequency. The electron beam is emitted from a gun by a cathode. The cathode is placed at the entrance to a tubular interaction space. The electronic beam is long and thin, and travels through the interaction space. A focusing device surrounds the interaction space and confines the electrons of the beam to appropriate paths.

In the interaction space, the electron beam interacts with an electromagnetic wave at microwave frequency. The resulting amplified electromagnetic microwave is extracted by an appropriate device at output of the interaction space. The electron beam ends its journey in a collector placed at output of the interaction space.

The interaction space has a microwave circuit that is generally a helical delay line in the case of a travelling wave tube. It is taken to a potential that is generally a ground potential.

After having yielded a part of its energy to the electromagnetic microwave, the electron beam still possesses substantial kinetic energy when it penetrates the collector. The collector dissipates this energy in the form of heat.

Owing to difficulties of focusing the electron beam, these tubes work with low values of perveance. Their low interaction efficiency (in the range of 4% at 80 GHz) results in high beam energy values being needed and, hence high absolute values of cathode voltage that may exceed several tens of kilovolts. The low interaction efficiency also results in low variations in the speed of the electrons when they enter the collector.

To obtain a total efficiency greater than the interaction efficiency, a collector under low pressure is generally used. This collector comprises one or more electrodes taken to potentials greater than or equal to that of the cathode but below that of the interaction space. The closer this potential to the cathode, the greater will be the interaction efficiency.

In the case of a collector with several electrodes or a multistage collector, the electrodes are taken to potentials that decrease with distance from the interaction space, the last electrode being at a potential close to or equal to that of the cathode.

In these collectors, it is necessary to see to the electrical insulation of the different electrodes and to ensure that there is a discharge of the energy dissipated in the form of heat by the electrons that strike the electrodes.

Collectors of this kind may be of the clamped type. The electrodes inserted into a vacuum-tight envelope are held in position with respect to one another by means of longitudinal dielectric rods that provide the interface between the electrodes and the envelope.

These rods also electrically insulate the electrons from one another and from the envelope which is generally taken to the potential of the interaction space, namely the ground potential.

The thermal discharge is done radially from the electrodes to the envelope through the rods.

The increase in absolute value of the voltages of the electrodes leads to an increase in the diameter of the rods and to a decrease in their number. The consequent increasing of the radial space required by the collector is not desirable. The reducing of the contact surface between the rods and the electrodes on the one hand and between the rods and the envelope on the other hand has a deleterious effect on the removal of the heat.

The need to improve the quality of heat removal has led to the replacing of the rods with annular spacers placed between the electrodes, in contact on one side with the vacuum-tight envelope and on the other side with one or two electrodes.

The contact surface between the annular spacers and the electrodes and between the annular spacers and the envelope is increased and the circulation of the thermal flux takes place more efficiently from the electrodes towards the envelope.

The amount of space required remains unchanged. The higher the voltages of the electrodes in terms of absolute value, the larger the number of annular spacers.

The need to improve the cooling has led to the use a cooling device around the envelope. The device may be a device with fins and the cooling may be done by radiation. This structure is used especially in space applications. The cooling device may also be a fluid circulation device with the cooling being done by conduction.

The electrical connections of the electrodes are generally done longitudinally through the back of the collector because of the cooling device. The back of the collector is a hot zone because many electrons strike the electrode that is furthest from the interaction space. This is especially the case when the tube is not master controlled.

The solders needed at the electrical connections of the electrodes place limits on the maximum temperature acceptable for the back of the collector and hence on the power of the electron beam.

The present invention seeks to overcome these drawbacks.

SUMMARY OF THE INVENTION

A collector according to the invention has a succession of electrodes and dielectric spacers in a sealed envelope under vacuum with an input wall and a back that are electrically conductive.

The dielectric spacers are of several types. Two successive electrodes are insulated by a spacer of a first type in contact with the electrodes and having no contact with the envelope. A spacer of a second type is firstly in contact with the electrode closest to the back and secondly in contact with the back. A spacer of a third type may be in contact firstly with the electrode closest to the input wall and secondly with the input wall. A structure of this kind provides for a gain in compactness.

If there is no third type of spacer, the spacer closest to the input wall is separated from said wall by a vacuum. This enables them to be brought closer to each other and enables the removal of the heat dissipated by the electrons towards the back.

A first type of spacer mechanically holds the electrodes that it keeps apart and is fixedly joined, for example, by brazing, to said electrodes.

The second type of spacer and the third type of spacer are fixedly joined, for example, by brazing, to an end electrode and to the envelope.

The spacers may be all annular but it is also possible to envisage a case where the second type of spacer has the shape of a crucible. In this configuration, the electrode closest to the back has a part in contact with the interior of the crucible. This part may be fixed, by brazing, for example, to the interior of the crucible but it may also be a metallization made in particular by cathode spraying, painting, or by chemical means.

When the second type of spacer is shaped like a crucible, the back may be attached to the spacer opposite the crucible. This attachment may be a brazing but the back may also be a metallization made in particular by cathode spraying, painting or by chemical means.

A cooling device may come into thermal contact with the back and when the back is placed on the spacer, the fastening of the cooling device is facilitated.

Between the input wall and the back, the envelope may have a part used as a thermal brake. This prevents propagation of the heat dissipated by the back towards the input wall.

The part used as a thermal brake may be fixed to the second type of spacer by means of a ring seal.

The electrical connections of the electrodes are made through the envelope in a zone located between the back and the input wall. The presence of the thermal brake prevents the connections from being carried to an excessively high temperature.

The present invention also relates to an electron tube comprising such a collector.

BRIEF DESCRIPTION OF THE DRAWINGS

Other features and advantages of the present invention shall appear from the following description, illustrated by the appended figures, of which.

In these figures, the same elements bear the same references. For the sake of clarity, the different elements have not been drawn to proportion.

MORE DETAILED DESCRIPTION

Figure 1:
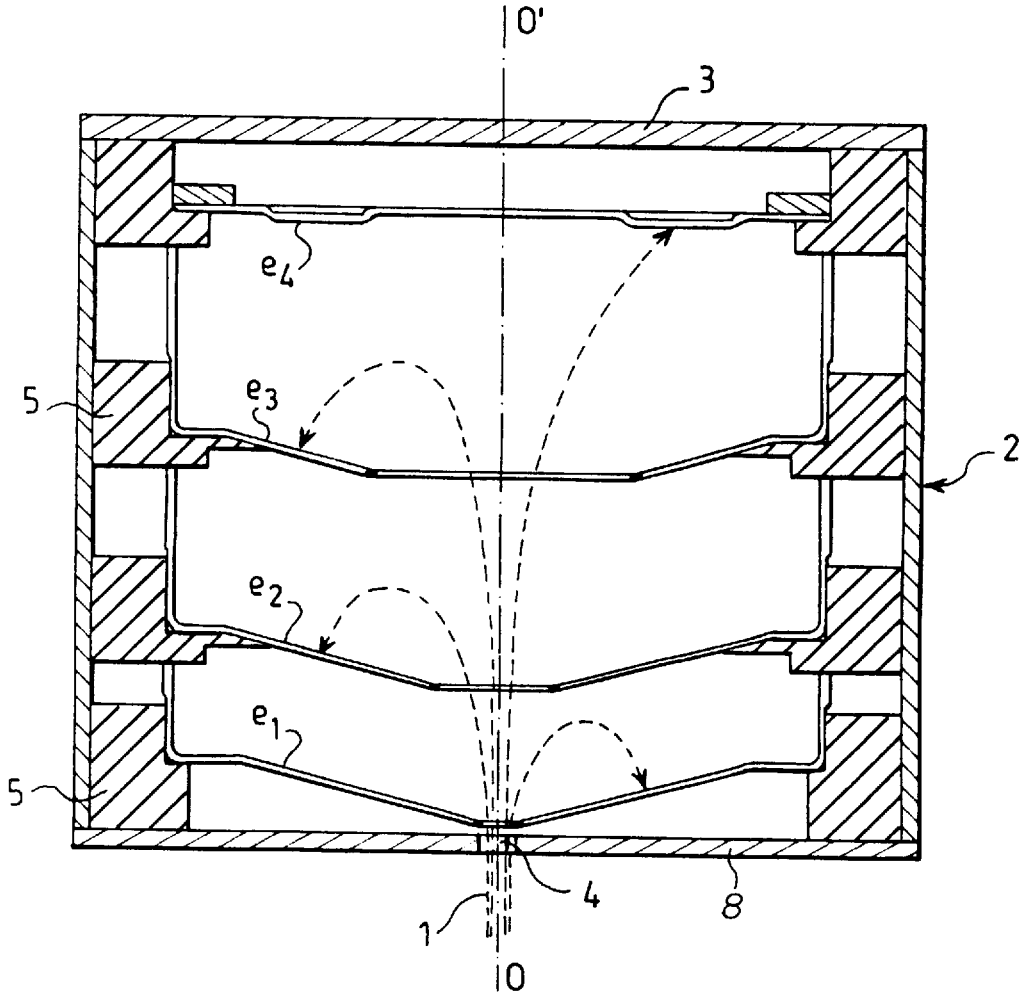
FIG. 1 PRIOR ART
FIG. 1 shows a longitudinal sectional view of a known type of collector.

FIG. 1 shows a sectional view of a prior art electron collector. The collector is built around an axis 00' that is the axis of propagation of the electron beam 1 produced by the tube with which the collector is associated. This tube is not shown.

This collector has a vacuum-tight conductive envelope 2 provided with a back 3 and, opposite the back, an input wall 8 with an input hole 4 through which the electrons penetrate the collector. The interior of the envelope 2 is under vacuum as is the interaction space. The electrons that penetrate the collector have just left the interaction space. Upline from the interaction space there is the electron gun with the cathode.

Within the envelope 2, there is a succession of electrodes e1, e2, e3, e4 taken to potentials that decrease with distance from the input hole 4.

The electrode e4 which is at the greatest distance from the input hole 4 is taken to a potential that is close to or equal to the potential of the cathode. The potential of the electrodes e1, e2, e3, e4 is relatively distant from the potential of the envelope 2, which is generally that of the interaction space, namely the ground.

The electrons penetrate the collector and, depending on the energy that they possess, they are intercepted by one of the electrodes.

Dielectric annular spacers 5 mechanically hold the electrodes e1, e2, e3, e4 in a position where they are separated from one another, on the one hand, and separated from the envelope 2, on the other hand. In addition to their mechanical role, they have the role of an electrical insulator with respect to the envelope 2 and with respect to two successive electrodes. They also have a thermal role. They contribute to conveying the thermal flux to be removed radially towards the envelope 2.

Figure 2:
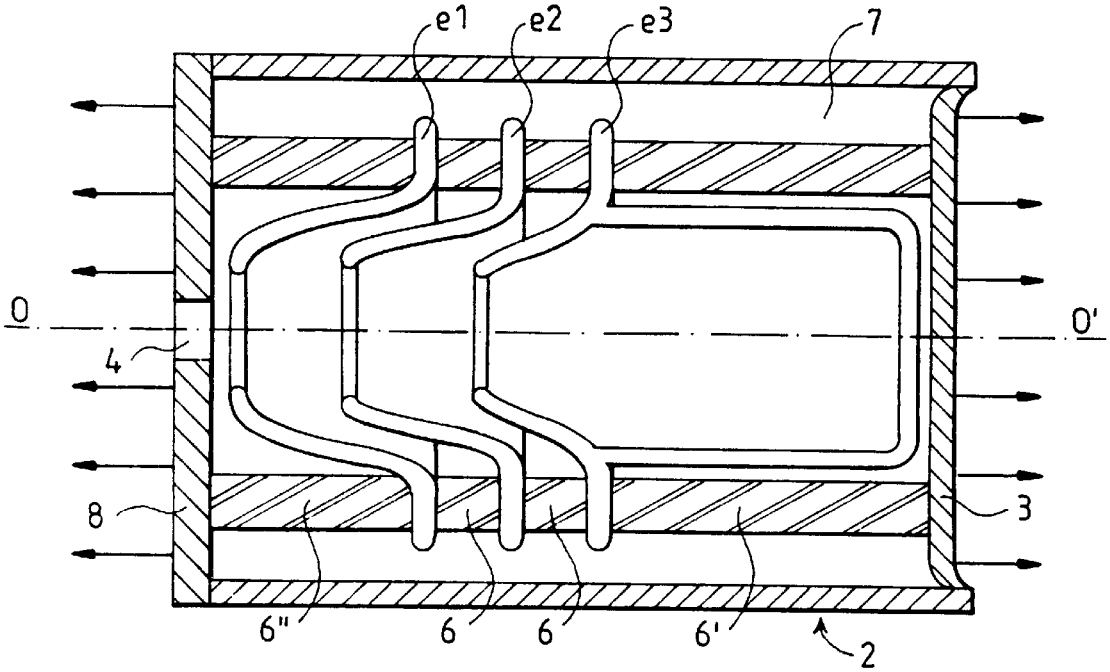
FIG. 2 shows a longitudinal sectional view of an exemplary collector according to the invention.

FIG. 2 shows a longitudinal sectional view of a collector according to the invention.

The vacuum-tight envelope referenced 2 has an electrically conductive back 3 and, opposite the back, it has an electrically conductive input wall 8 with an input hole 4 for the electrons (which are not shown). Within the envelope 2, there is the succession of electrodes e1, e2, e3. In the example of FIG. 2, there are only three of them, but it is possible to envisage putting two or more of them. In FIG. 2, the last electrode e3 has the shape of a crucible. It collects a large number of electrons, especially if the tube is not driven.

The electrodes e1, e2, e3 are taken to potentials that decrease with distance from the input hole 4. The electrode e3 which is at the greatest distance may, for example, be taken to a potential close to or equal to that of the cathode.

The envelope 2 for its part is taken to a potential substantially equal to that of the interaction space.

The difference between this collector and that of FIG. 1 lies chiefly in the dielectric spacers 6, 6' and 6".

In this example, they are all substantially annular. It is possible to distinguish several types of spacers. Two successive electrodes e1 and e2, e2 and e3 are separated by a first type of spacer 6. A spacer 6 of a first type is in contact with the two successive electrodes.

These spacers 6 of a first type have no contact with the envelope 2 and a space 7 is made between them and the envelope 2. In this space 7, vacuum prevails.

The spacers 6 of the first type have a role of mechanically holding the electrodes with respect to one another. The electrodes e1, e2, e3 are fixed to the spacers 6 of a first type by brazing, for example. They are also used to electrically insulate two successive electrodes e1, e2, e3. The decreasing potentials of the different electrodes are relatively close to one another and the spacers are sized axially to bear the difference between the potentials of the two electrodes that they separate.

The fact of providing for vacuum between the spacers 6 of the first type and the envelope 2 enables a reduction in the radial space requirement of the collector. A vacuum is a far better electrical insulator than the surface of dielectric materials such as ceramic.

From the thermal point of view, the spacers 6 of the first type provide for a longitudinal flow of heat towards the spacers of the other types.

The electrode e3 closest to the back 3 is separated from it by a spacer 6' of a second type. The electrode e1 closest to the input wall 8 is separated from this wall by a spacer 6" of a third type. The spacer 6' of a second type is in contact firstly with the electrode e3 closest to the back 3 and secondly with the back 3. The spacer 6" of the third type is in contact firstly with the electrode e1 closest to the input wall 8 and secondly with the input wall 8. The spacers 6', 6" of the second and third type have a role of mechanically holding the far end electrodes e1, e3 in the envelope 2. They are fixed by one side to an electrode e1 or e3 and by the other side either to the back 3 or to the input wall 8. This fixing is obtained by brazing, for example.

They are also used for the electrical insulation of the end electrodes e1, e3 from the envelope 2. They are sized to take the difference in potential between the end electrodes and the envelope 2. Preferably, the width of the spacer 6' of a second type measured between the electrode e3 and the back 3 is longer than that of the spacer 6" of a third type measured between the electrode e1 and the input wall 8. The electrode e3 is taken to a potential that is at a greater distance from the ground potential than that of the electrode e1. Preferably also, the length of the spacers 6 of a first type measured between two successive electrodes is shorter than that of the spacer 6' of a second type and that of the spacer 6" of a third type.

From the thermal point of view, the spacers 6', 6" of the second and third type provide for a longitudinal flow of heat towards the input wall 8 and the back 3.

An improvement of this collector may be obtained by eliminating the third type of spacer 6".

Figure 3:
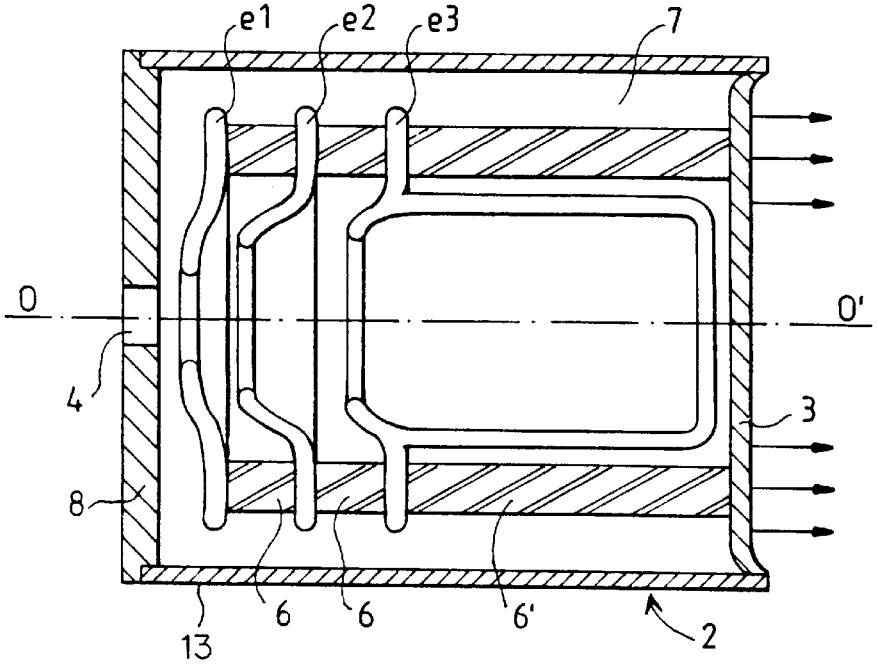
FIG. 3 shows a longitudinal sectional view of another exemplary collector according to the invention.

This variant is shown in FIG. 3.

The electrical insulation of the first electrode e1 with respect to the input wall 8 is provided by the vacuum prevailing in the envelope 2. Because of the very good dielectric properties of the vacuum, the first electrode e1 may be closer to the input wall 8 than in the previous case. The collector thus made is axially shorter.

From the thermal point of view, the flow of heat takes place towards the back 3. The part 13 of the envelope 2 between the input wall 8 and the back 3 may advantageously be made of a material that is electrically conductive but is a poor conductor of heat, for example stainless steel. This part 13 serves as a thermal brake and prevents the heat dissipated at the back 3 from being propagated towards the interaction space.

Figure 4:
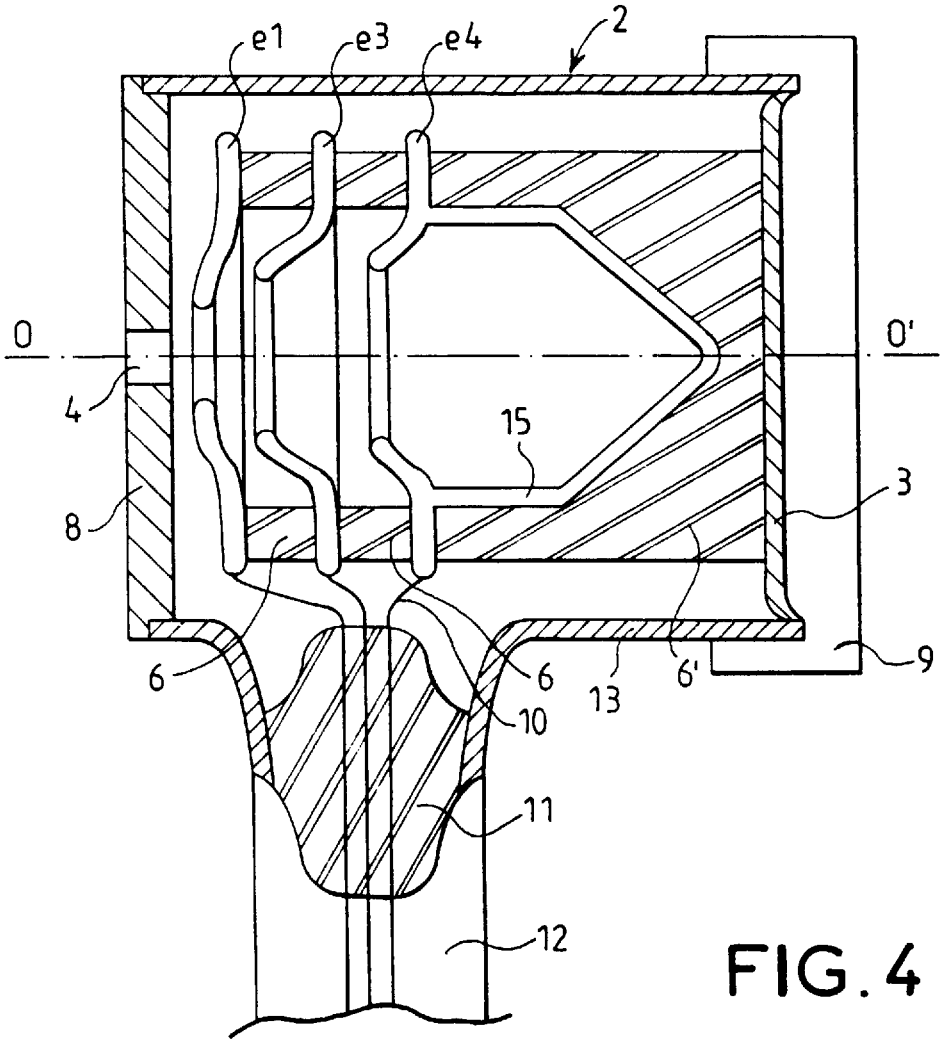
FIG. 4 shows a longitudinal sectional view of a third exemplary collector according to the invention.

The flow of heat may be improved. FIG. 4 illustrates this variant. Instead of being annular and pierced from one side to the other, the spacer 6' of a second type is in the shape of a crucible. The last electrode e4 has a part 15 that is in contact with the interior of the crucible.

The surface dielectric strength of insulators is smaller than the volume dielectric strength of said insulators. By inserting the last electrode e4 into the crucible of the spacer 6', the risks of breakdown between the last electrode e4 and the back 3 are avoided. The last electrode e4 may be brazed for example, into the crucible. The distance between the last electrode e3 and the back 3 may be reduced with respect to the variant described here above. The dimensions of the spacer 6' are designed to withstand a voltage close to or equal to that of the cathode.

The removal of the dissipated heat is far more efficient than in the variant of FIG. 3, for there is a large contact surface between the back 3 and the spacer 6'. The back 3 may be formed by an electrically conductive element sealed by brazing for example, to the spacer 6' opposite the crucible.

This FIG. 4 shows, at the end of the collector, a cooling device 9 with fins that are fixed to the back 3 by brazing for example. This device can be fitted into the envelope.

Another advantage of a collector according to the invention lies in the electrical connections of the electrodes e1, e3, e4.

These electrical connections can be made substantially transversally to the axis 00', namely transversally to the direction of the electrons at their entry into the collector. This structure is made possible because, since the flow of the dissipated heat takes place towards the back 3 of the envelope, it is no longer necessary to place a cooling device all around the envelope as in the prior art. The fact of making the connections emerge transversally prevents the use of longitudinal connections. These longitudinal connections, which are difficult to make, would go through the different electrodes.

Each electrode e1, e3, e4 is connected to an electrical conductor 10. The conductors 10 come out of the envelope 2 in a zone between the back 3 and the input wall 8 by crossing one or more imperviously sealed insulating passages 11 that may advantageously be placed substantially at the input wall 8. If the voltages of the electrodes are close to one another, a single passage 11 may be enough. After connection with a supply wire, each conductor is coated with an insulator material 12. A single coating may be enough for all the conductors 10.

The electrical conductors 10 come out of the envelope 2 in a zone where the temperature is far lower than at the back 3, especially because of the presence of the thermal brake 13. The operation is no longer hampered by the temperature limit dictated by the coating and the connection with the supply wire.

Figure 5:
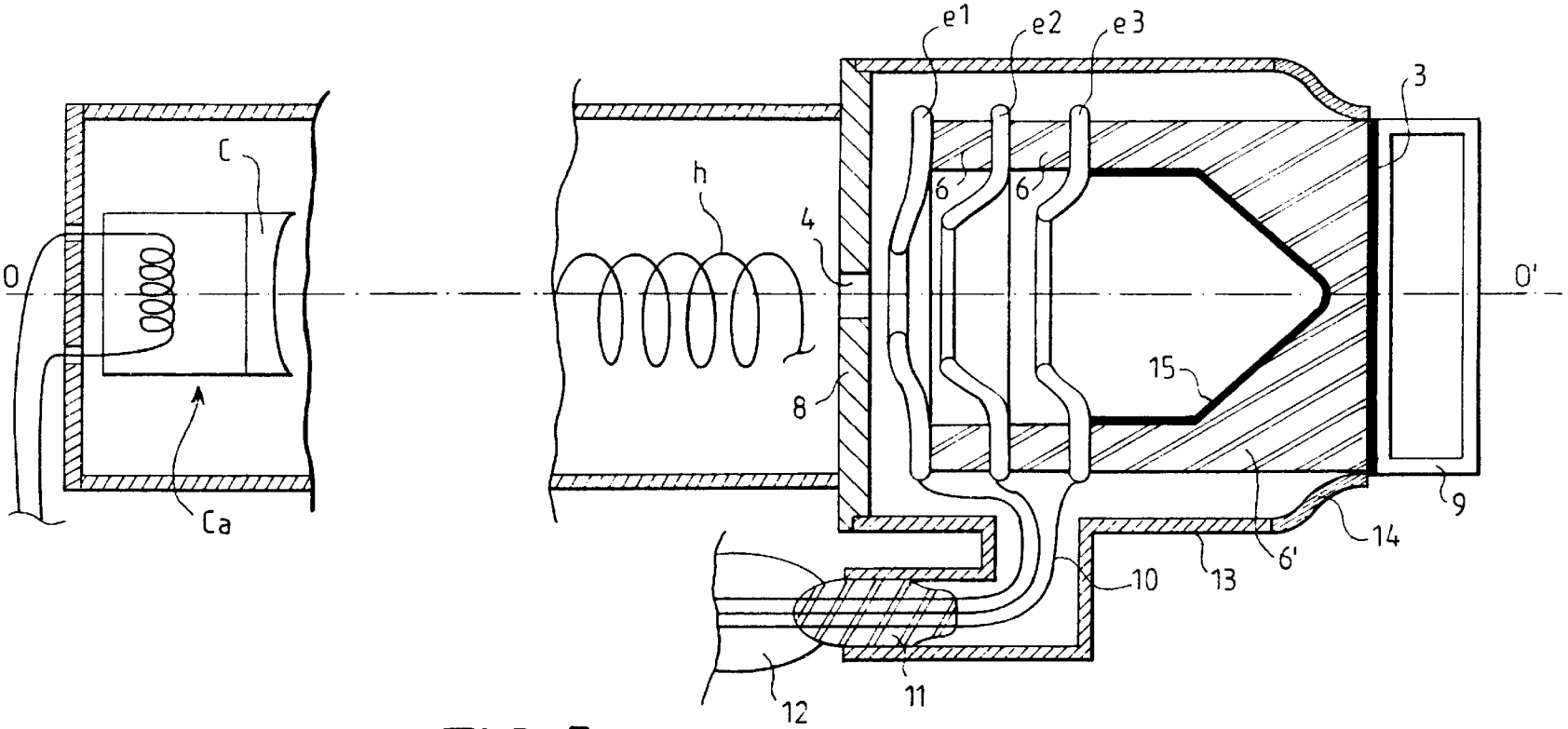
FIG. 5 shows a schematic longitudinal view of an electron tube according to the invention.

FIG. 5 gives a schematic view of an electron tube comprising a collector according to the invention.

The interaction space shown in the form of a helix bears the reference h and the electron gun and the cathode respectively bear the references ca and c.

The collector shown has several differences with the collector of FIG. 4. The part 15 of the last electrode e3 is made by a metallization deposited inside the dielectric crucible. This deposit may be made by the cathode spraying of a conductive material that adheres well to the dielectric material of the spacer 6' or by painting covered, if necessary, with conductive material that is a non-getter or a low getter under vacuum. Another possibility is to carry out the deposition by chemical means.

Another difference lies in the back 3 of the envelope 2. Here the back 3 has a metallization that can be made by cathode spraying, painting or chemical deposition on the dielectric spacers 6' opposite the crucible. This variant facilitates the mounting of the cooling device 9 by brazing. The cooling device 9 herein is a cooling device with fluid circulation.

In this variant, the part 13 of the envelope 2 located between the back 3 and the input wall 8 may be fixedly joined to the spacer 6' by means of an electrically conductive ring 14. The ring 14 is fixedly joined by brazing for example, to the proximity spacer 6' of the back 3.

There is also a difference regarding the leads of the electrical connections of the electrodes e1, e2, e3. The connections are now made towards the input wall 8 substantially in parallel to the axis 00' but still through the part 13 of the envelope 2 located between the back 3 and the input wall 8. Of course, the lead-out direction of the electrical connections may be in any direction.

With an lead-out arrangement of this kind, the compactness of the collector is improved. Since the connections are accessible towards the interactive space h, it is possible to group them with the connections of the gun so as to have only one high voltage connection.

It is possible, without going beyond the scope of the invention, to achieve a different combination of the characteristics of the collector just described.

What is claimed is:

1. A multistage electron collector for electron tubes, said collector comprising a vacuum-tight envelope with an input wall of said electrons and a back that are electrically conductive, this envelope containing, in the vacuum, a succession of electrodes and dielectric spacers, two successive electrodes being insulated by a spacer of a first type in contact with the two electrodes and having no contact with the envelope, a spacer of a second type being in contact firstly with the electrode closest to the back and secondly with the back, wherein the electrode closest to the input wall is separated, only by the vacuum from the input wall, and wherein the envelope comprises, between the input wall and the back, a part used as a thermal brake.

2. A collector according to claim 1, wherein the spacers of a first type are fixedly joined to the electrodes, the spacers of a second type being fixedly joined to the electrode closest to the back and to the envelope.

3. A collector according to claim 1, wherein the spacers are annular.

4. A collector according to claim 1, wherein the spacer of a second type is crucible-shaped, the electrode closest to the back comprising a part that is in contact with the interior of the crucible.

5. A collector according to claim 4, wherein the part is fixed to the interior of the crucible.

6. A collector according to claim 5, wherein the part is a metallization.

7. A collector according to claim 5, wherein the part is a metallization made by cathode spraying, painting, or chemical means.

8. A collector according to claim 4, wherein the back is a metallization made on the spacer of a second type opposite the crucible.

9. A collector according to claim 4, wherein the back is fixed to the spacer of a second type opposite the crucible.

10. A collector according to claim 4 wherein the part is fixed to the interior of the crucible by brazing.

11. A collector according to claim 4, wherein the back is fixed to the spacer of a second type opposite the crucible by brazing.

12. A collector according to claim 4, wherein the back is a metallization made by cathode spraying, painting, or chemical means on the spacer of a second type opposite the crucible.

13. A collector according to claim 1, wherein a cooling device is in thermal contact with the back.

14. A collector according to claim 1, wherein the part used as a thermal brake is fixed to the spacer of a second type by means of a ring seal.

15. A collector according to claim 1, wherein electrical conductors coming out of the electrodes go through the envelope in a zone located between the back and the input wall.

16. An electron tube comprising a collector according to one of the claims 1 to 13, 14–15.

* * * * *